US005791333A

United States Patent [19]

Bennett

[11] Patent Number: 5,791,333

[45] Date of Patent: Aug. 11, 1998

[54] GAS RANGE BURNER SYSTEM

[76] Inventor: Herbert Bennett, 12205 Flatlands Ave. #5L, Brooklyn, N.Y. 11207

[21] Appl. No.: 843,818

[22] Filed: Apr. 21, 1997

[51] Int. Cl.[6] ..... F24C 15/10

[52] U.S. Cl. ..... 126/214 D; 126/214 R; 126/215

[58] Field of Search ..... 126/211, 214 R, 126/215, 216, 217, 41 R, 39 R

[56] References Cited

U.S. PATENT DOCUMENTS

| | | | |
|---|---|---|---|
| 983,413 | 2/1911 | Swafford | 126/214 D |
| 1,376,241 | 4/1921 | Wright | 126/214 D |
| 1,429,826 | 9/1922 | Baecker | 126/214 D |
| 1,447,847 | 3/1923 | Hines et al. | 126/214 D |
| 1,546,919 | 7/1925 | Dore | 126/214 D |
| 1,658,580 | 2/1928 | Thaxton | 126/214 D |

*Primary Examiner*—James C. Yeung
*Attorney, Agent, or Firm*—Gottlieb, Rackman & Reisman, P.C.

[57] ABSTRACT

An improved burner system for a gas range is provided. The burner system includes an annular metal pan through which the gas flame selectively projects, and an annular grill or grate overlying the pan on which the bottom of a cooking utensil is selectively supported. In addition, the inventive system includes an element for directing the gas flame inwardly and upwardly towards the bottom of the utensil, as well as for substantially reducing heat loss generated by flame operation.

8 Claims, 3 Drawing Sheets

GAS RANGE BURNER SYSTEM

BACKGROUND OF THE INVENTION

This invention relates to a gas range burner system, and more particularly, to a burner system for a gas range which requires less gas for cooking than conventional gas range burners.

Gas cooking is perhaps the most widely used type of cooking found in homes and apartments. Unlike electric cooking, which is difficult to control, gas cooking provides precise control, since the gas flame is selectively turned on and off, and/or raised and lowered in intensity, by the operator simply adjusting the controls of the oven or cook top. Moreover, since the gas flame reacts instantly to the operator's selection, cooking is made far more simple.

A conventional gas stove or a cook top usually includes anywhere from four to six individually controlled burners in which a gas flame is controllably operated. Each burner typically includes an annular metal pan through which the gas flame depends and an annular grill overlying the metal pan. The grill is designed to selectively accommodate a pot or other cooking utensil seated thereon.

While gas cooking is obviously quite advantageous, it does have a number of deficiencies. In the first place, the gas flame tends to operate somewhat inefficiently. In particular, much of the heat generated by the gas flame is not directed precisely upward towards the pot, but is instead angled upward so that a substantial quantity of heat is simply lost around the edge of the pot. In addition, gas flames tend to emit pollutants into the environment, more so when the flame is operated at a "high" setting to compensate for the heat loss.

Accordingly, it would be desirable to provide an improved gas burner system which overcomes the above disadvantages.

SUMMARY OF THE INVENTION

Generally speaking, in accordance with the invention, an improved burner system for a gas range is provided. The burner system includes an annular metal pan through which the gas flame selectively projects, and an annular grill or grate overlying the pan on which the bottom of a cooking utensil is selectively supported. In addition, the inventive system includes an element for directing the gas flame inwardly and upwardly towards the bottom of the utensil, as well as for substantially reducing heat loss generated by flame operation.

More specifically, the inventive burner system includes a pair of elements fitted between the metal pan and the grill for rendering the burner system far more economical than those of the prior art. The first of these elements comprises an outer metal ring which is seated on the burner pan, and which is designed for selectively receiving the grill thereon.

The second element comprises a ceramic ring inwardly disposed within a flange member of the metal ring. The ceramic ring insulates the gas flame, thereby substantially reducing heat loss that is typically present in conventional open flame cooking. The ring also directs the flame towards the cooking utensil seated on the grill so that heating by the gas flame is rendered more efficient.

Accordingly, it is an object of the invention to provide an improved gas burner system.

Still another object of the invention is to provide a gas burner system which substantially reduces the requirement for gas during cooking.

Yet a further object of the invention is to provide a gas burner system that substantially reduces heat loss during the cooking process.

Yet another object of the invention is to provide a gas burner system which reduces the emission of pollutants into the environment.

Still other objects and advantages of the invention will in part be obvious and will in part be apparent from the following description.

The invention accordingly comprises a construction having the features, properties and relation of components, as exemplified in the following detailed disclosure, and the scope of the invention will be indicated in the claims.

BRIEF DESCRIPTION OF THE DRAWINGS

For a fuller understanding of the invention, reference is made to the following description, taken in connection with the attached drawings, in which.

DETAILED DESCRIPTION OF THE PREFERRED EMBODIMENT

Figure 1:
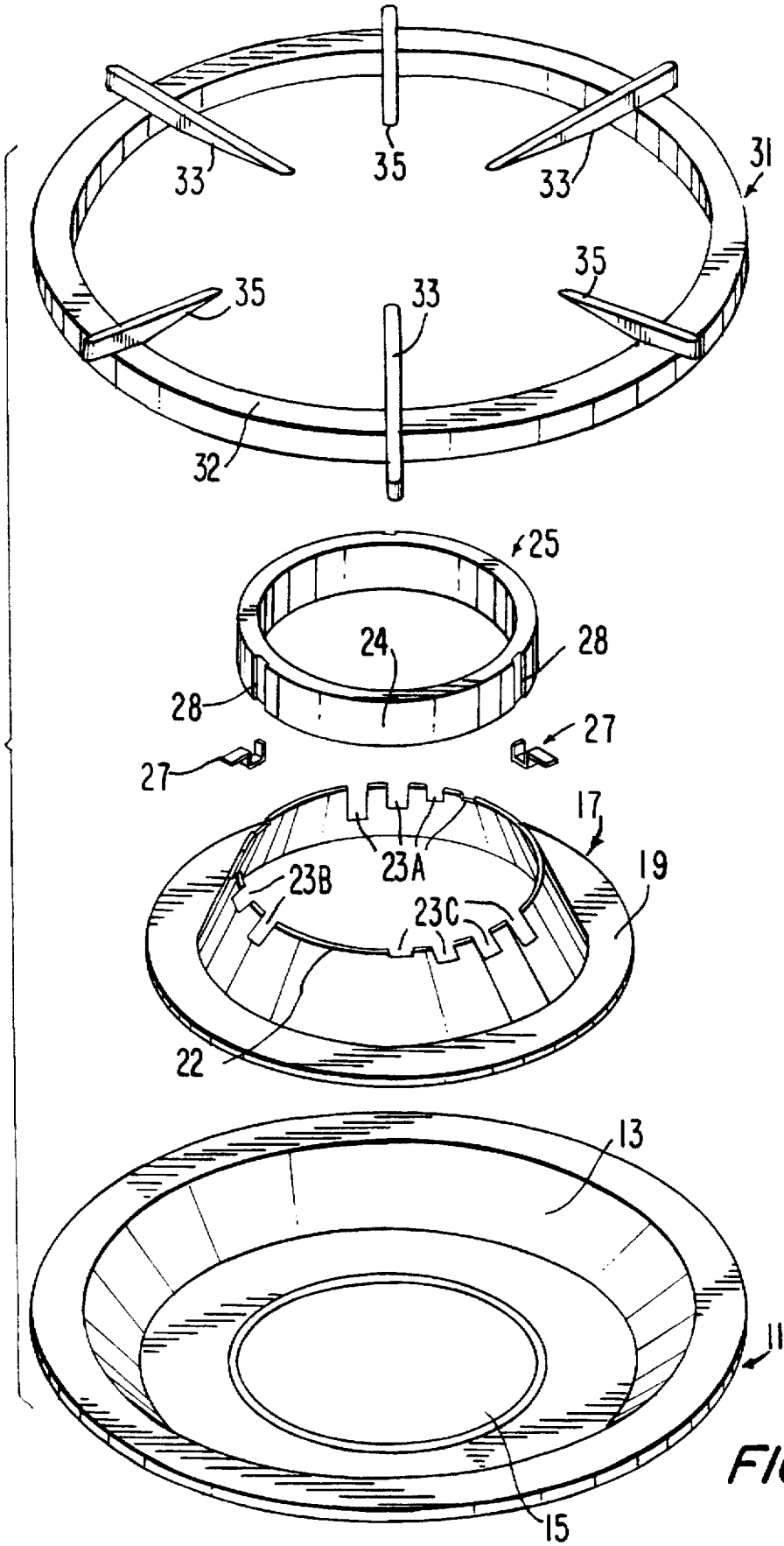
FIG. 1 is an exploded perspective view of the elements of the inventive gas burner system.

Referring to FIG. 1, burner system 9 made in accordance with the invention comprises a base or pan 11, an outer metal ring 17, a ceramic ring 25 disposed within outer ring 17, and a conventional grill or grate 31. Base or pan 11 comprises an annular metal member 13 which defines a circular opening at 15. When mounted on a gas range top, opening 15 receives therethrough the gas flame emitted from the individual burner.

Outer ring 17 sits on top of base 11 and comprises a rim 19 and an upwardly depending annular flange 21. Flange 21 defines an annular edge 22 having a plurality of notch groups comprising notches 23*a*, 23*b* and 23*c*. Each of the notch groups are defined by four notches with each group radially disposed equidistant from each other. As shown in the drawings, there are three notch groups formed in ring 17.

Ceramic ring 25, which fits within flange 21 of outer ring 17, includes three slots 28, each disposed equidistant from the others along ring 25. Each of slots 28 of ring 25 is selectively coupled to one of the same size notches in each of the notch groups of ring 17. This is achieved by means of metal clips 27 (see FIG. 2), which engage slots 28 of ring 25 to the selected sized notches of outer ring 17.

Figure 3:
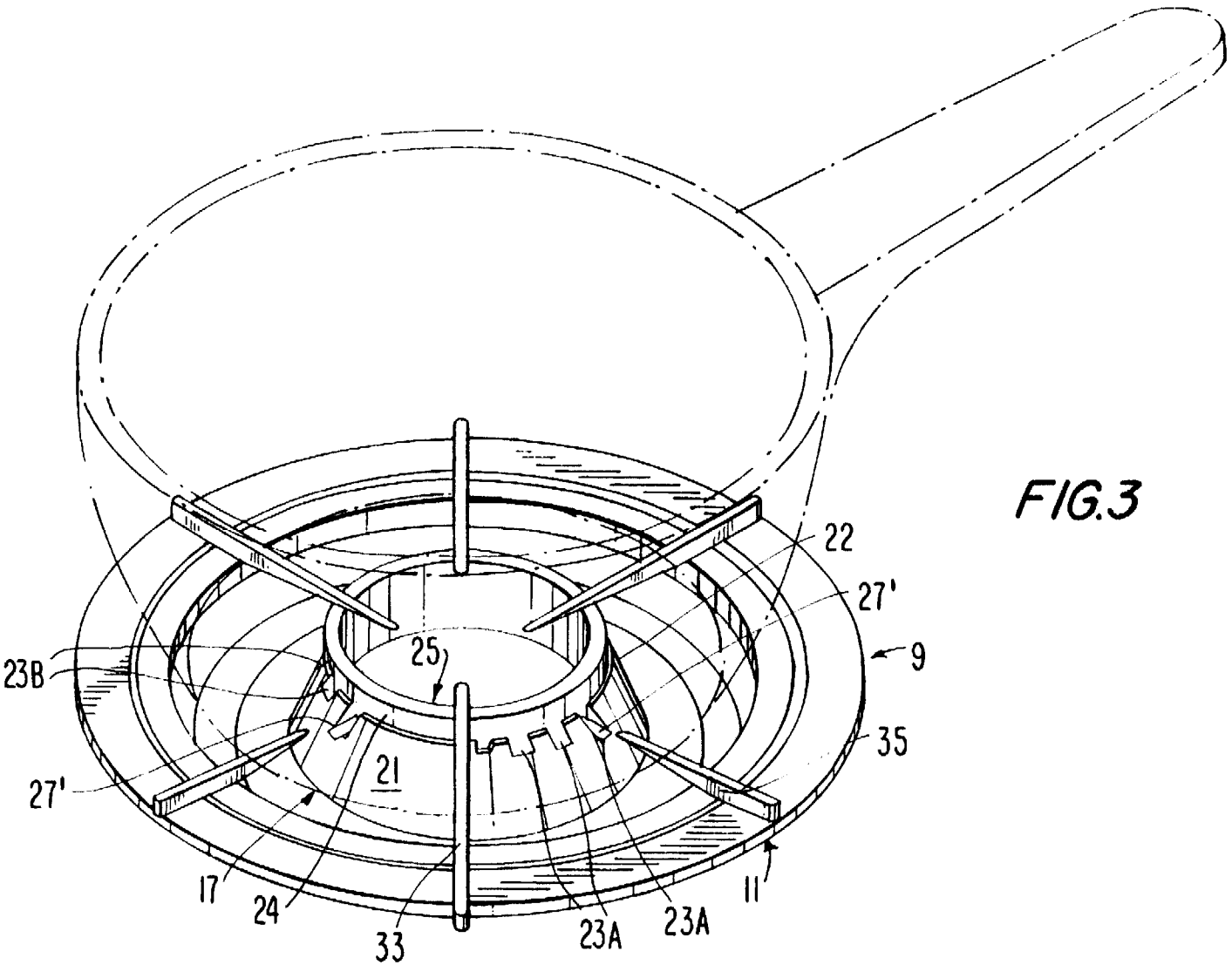
FIG. 3 is a perspective view like FIG. 2, but with a slightly different gas burner system design.

Alternatively, as shown in FIG. 3, ceramic ring 25 is formed with three outwardly depending brackets 27', equally disposed equidistant from the others along radial surface 24 of ring 25. Each of brackets 27' extends radially outwardly from ring 25 such that brackets 27' can fit in and otherwise be received by one of the same sized notches. In other words, each of brackets 27' will fit within all of the small size notches, all of the medium size notches or all of the large size notches.

With either the use of clips or brackets, as described, ring 25 can be disposed within outer ring 17 at varying heights with respect to flange 21 so as to accommodate grills 31 of various sizes. In FIG. 3, by way of example, ceramic ring 25 is fitted inside flange 21 of outer ring 17 with brackets 27 being received by the larger size notches of notch groups 23*a*, 23*b* and 23*c*.

Figure 2:
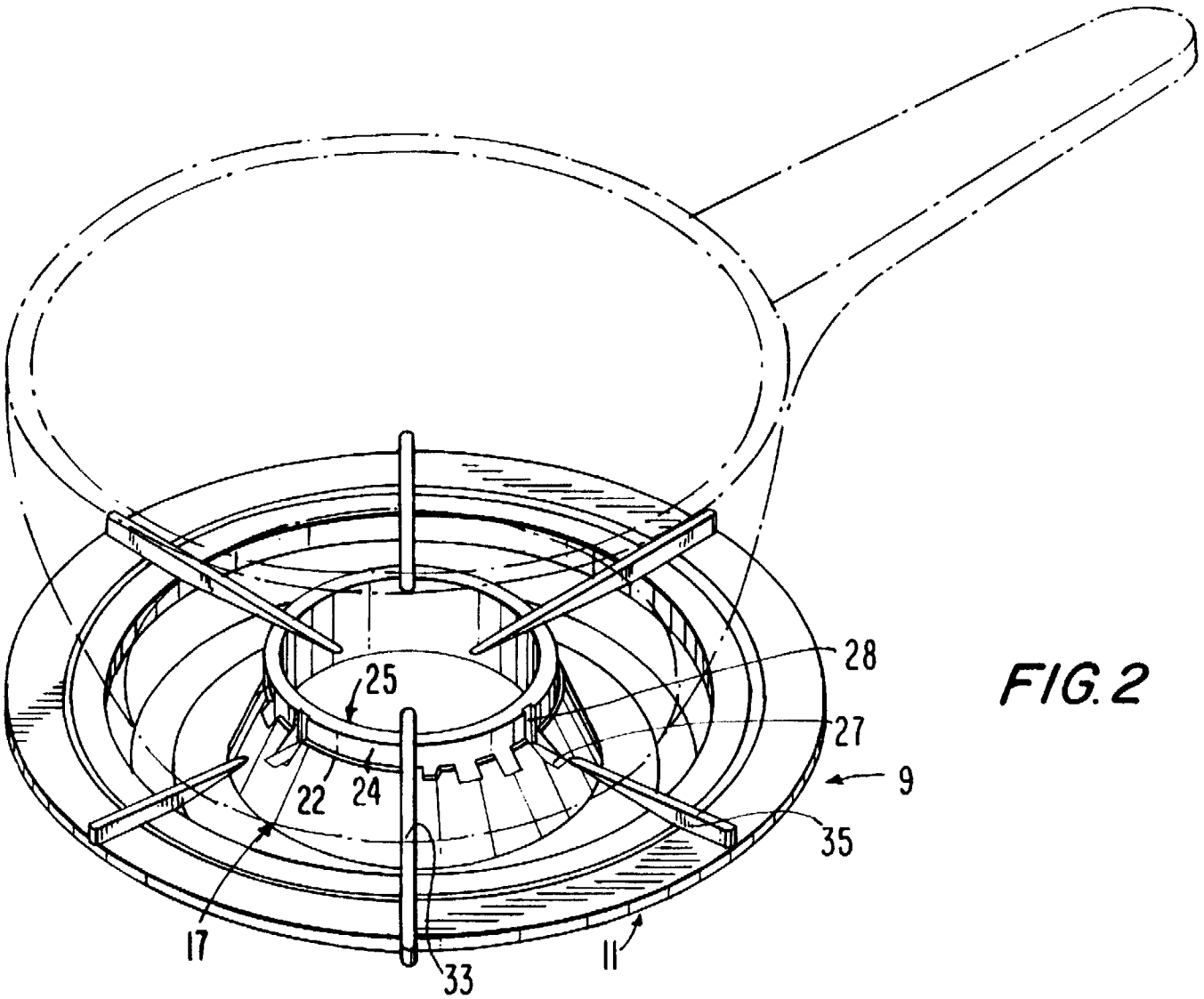
FIG. 2 is a perspective view illustrating a cooking utensil seated on the gas burner system of the invention.

Grill 31 is of conventional design and comprises an outer grill ring 32, a series of first inwardly depending support brackets 33 and a series of second inwardly depending support brackets 35. As is well known, support brackets 33 and 35 are used for supporting a pot or other cooking utensil over the burner, as best depicted in FIGS. 2 and 3.

In operation, a gas flame (not shown) is projected upwardly through stove base 11 and ceramic ring 25 by actuating the control knob of the gas range. Because ring 25 is made of an insulating ceramic material and otherwise functions to guide the gas flame upwardly, heat is generated directly on the pot and heat loss is substantially reduced. In fact, tests on the inventive burner design have shown that heat loss is reduced to between about 40% and 50% as compared to conventional burner systems.

In addition, and because the flame is directed upwardly and heat loss is reduced, gas pressure may in turn be substantially reduced without compromising the cooking process. Moreover, because less gas burning is taking place, the amount of sulfur emitted is substantially reduced. This is very significant, especially since such fumes can pollute the environment.

In comparative testing, it has been shown that boiling water utilizing the burner system of the invention takes substantially less time even when gas pressure is reduced up to 50%. It can therefore be appreciated that use of the inventive burner system will achieve substantial reduction in gas energy costs.

When using the burner system of the invention, the unit is first positioned between the grill or grate (on which a pot is seated) and the metal pan, after which the gas range is lit or ignited in a normal manner. The gas flame typically will extend beyond the perimeter of the base of the pot. Therefore, gas pressure may be reduced from 40–50%, rendering cooking far more economically efficient.

It will thus be seen that the objects set forth above, among those made apparent from the preceding description, are efficiently attained, and since changes may be made without departing from the spirit and scope of the invention, it is understood that the above description is merely illustrative and does not otherwise limit the scope of the invention. The claims that follow define the inventive scope.

I claim:

1. A burner system for a gas range top comprising:

a metal pan through which a gas flame selectively projects;

a metal grill or grate for selectively overlying the pan on which the bottom of a cooking utensil may be selectively supported;

a ring situated underneath said grill and disposed above said pan for directing said gas flame upwardly toward said utensil bottom and insulating said flame in order to substantially reduce the loss of heat generated thereby; and an outer supporting metal ring seated on said pan for selectively adjusting the height of said ring above said pan in order to accommodate various size grills, said ring comprising an annular base with an upwardly depending annular flange on which said insulating ring is supported.

2. The system of claim 1, wherein said flange of said supporting ring includes a plurality of corresponding notches used for supporting said insulating ring.

3. The system of claim 2, wherein said plurality of notches define notch groups with notches of varying size for receiving said insulating ring at various heights.

4. The system of claim 2, wherein said insulating ring includes a plurality of slots for engagement with said corresponding notches of said supporting ring.

5. The system of claim 4, wherein each of said slots engage one of said corresponding notches by means of a clip.

6. The system of claim 2, wherein said insulating ring includes a plurality of outwardly projecting support brackets selectively carried by said corresponding notches of said supporting ring.

7. The system of claim 2, wherein said insulating ring is made of a ceramic material.

8. An adapter unit for a gas burning system comprising:

an insulating ring for disposition above a metal pan of said burner system and through which a gas flame selectively projects; and a supporting metal ring for being seated on said pan and for carrying said ceramic ring at varying heights above said pan in order to accommodate various sized metal grills or grates for selectively overlying said ceramic ring;

wherein said insulating ring directs said gas flame upwardly therethrough while insulating said flame in order to substantially reduce heat loss;

wherein said supporting metal ring comprises a base with an upwardly depending flange on which said insulating ring is carried.

* * * * *